US007303412B1

(12) United States Patent
Liao

(10) Patent No.: US 7,303,412 B1
(45) Date of Patent: Dec. 4, 2007

(54) HOLDING DEVICE AND ELECTRONIC PRODUCT EMPLOYING THE SAME

(75) Inventor: Feng-Liang Liao, Shenzhen (CN)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/309,724

(22) Filed: Sep. 15, 2006

(30) Foreign Application Priority Data

Mar. 17, 2006 (TW) ..... 95204474

(51) Int. Cl.
*H01R 13/44* (2006.01)

(52) U.S. Cl. ..... 439/135; 439/327

(58) Field of Classification Search ..... 439/135, 439/327, 328, 940
See application file for complete search history.

(56) References Cited

U.S. PATENT DOCUMENTS

| | | | | |
|---|---|---|---|---|
| 6,056,579 | A * | 5/2000 | Richards et al. | 439/358 |
| 6,319,037 | B1 * | 11/2001 | Lai | 439/327 |
| 7,021,953 | B2 | 4/2006 | Kawamae | |
| 2005/0186824 | A1 * | 8/2005 | Liebenow | 439/327 |

* cited by examiner

*Primary Examiner*—Ross N. Gushi
(74) *Attorney, Agent, or Firm*—Wei Te Chung

(57) ABSTRACT

A holding device (40) used for helping fasten an interface card (10) in a peripheral component interconnect (PCI) connector (20) includes a top wall (42), at least a pair of opposite sidewalls (44) for clamping the two sides of the PCI connector, and at least a pair of holding portions (48) for fastening the interface card. Wherein the sidewalls connect with the top wall, and the holding portions connect with the top wall.

12 Claims, 4 Drawing Sheets

HOLDING DEVICE AND ELECTRONIC PRODUCT EMPLOYING THE SAME

FIELD OF THE INVENTION

The present invention pertains to a holding device, and particularly to a holding device for a peripheral component interconnect.

DESCRIPTION OF RELATED ART

Presently, an interface card is often electrically connected with a circuit board via a peripheral component interconnect (PCI) connector. Often a latching member is assembled on the circuit board for preventing the interface card disengaging from the PCI connector accidentally.

The latching member is usually mounted on the circuit board. But, with the development of integrated circuitry, space is at a premium and there is little room for the latching member.

Therefore, a need exists in the industry to overcome the aforementioned deficiencies and inadequacies.

SUMMARY OF THE INVENTION

In an exemplary embodiment, a holding device used for helping fasten an interface card in a peripheral component interconnect (PCI) connector includes a top wall, at least a pair of opposite sidewalls used for clamping the two sides of the PCI connector, and at least a pair of holding portions used for fastening the interface card. Wherein the sidewalls connect with the top wall, and the holding portions connect with the top wall.

Other advantages and novel features will become more apparent from the following detailed description when taken in conjunction with the accompanying drawings, in which:

DETAILED DESCRIPTION OF THE INVENTION

Figure 1:
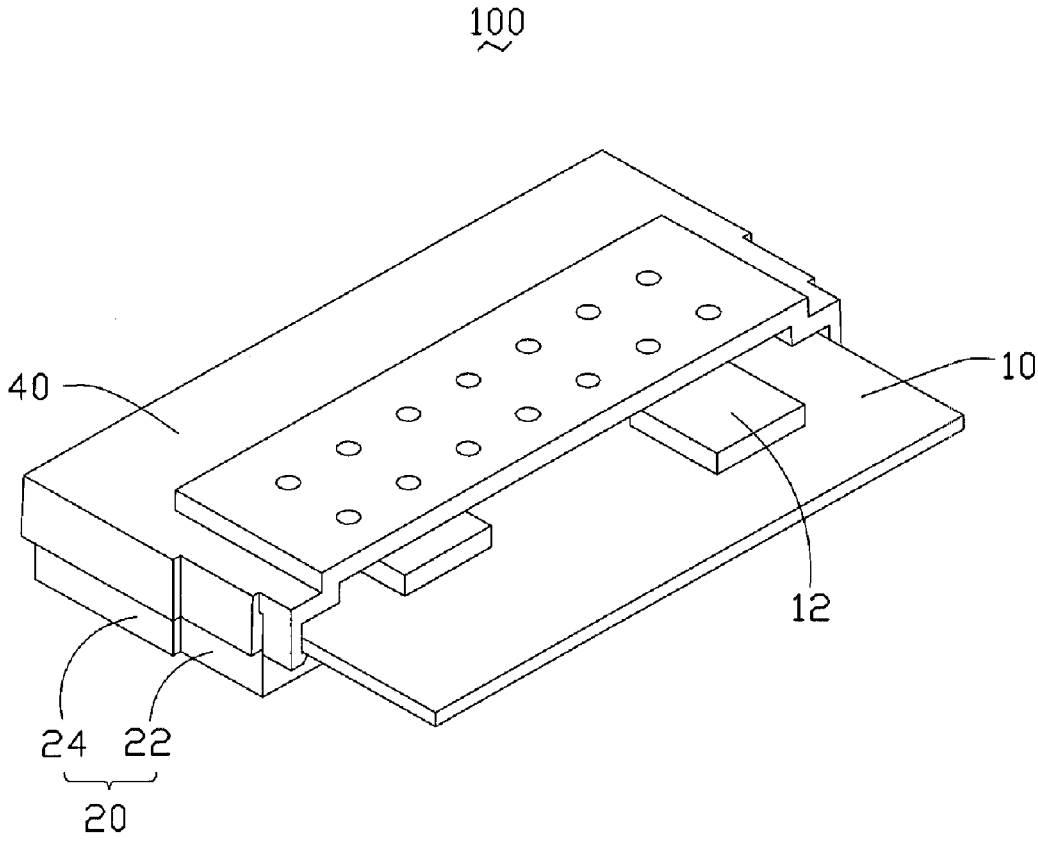
FIG. 1 is an assembled view of an electronic product in accordance with an exemplary embodiment of the present invention, the electronic product includes an interface card, a peripheral component interconnect (PCI) connector, and a holding device.

Referring to FIG. 1, an electronic product 100 in accordance with an exemplary embodiment of the present invention is shown. The electronic product 100 comprises a holding device 40, a peripheral component interconnect (PCI) connector 20, and an interface card 10 received in the PCI connector 20. In this embodiment, the holding device 40 comprises plastic but other suitable material may be used. The PCI connector 20 comprises a front portion 22, and a back portion 24 having a width greater than that of the front portion 22.

Figure 2:
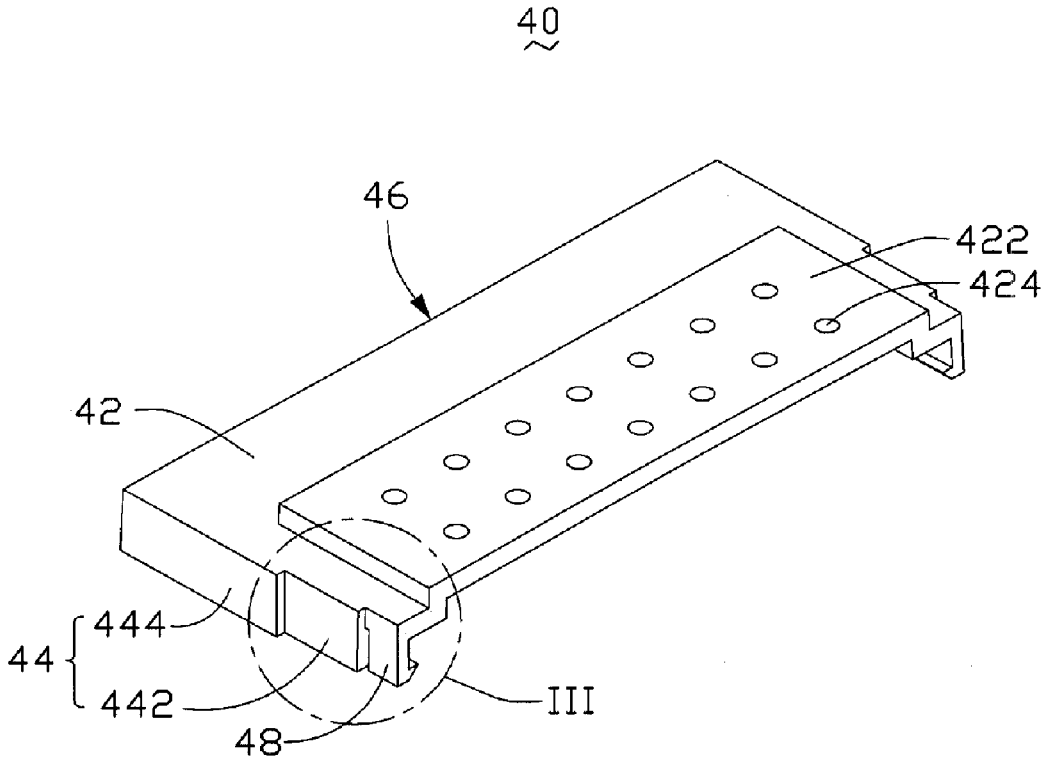
FIG. 2 is a perspective view of the holding device of FIG. 1.

Referring also to FIG. 2, the holding device 40 comprises a top wall 42, a pair of opposite sidewalls 44, a back wall 46, and a pair of opposite holding portions 48. The sidewalls 44 connect with the top wall 42, and the back wall 46 connects with the top wall 42 and the sidewalls 44. The top wall 42 comprises a rectangular raised portion 422 projecting from an area extending from a middle of the top wall 42 to an edge away from the back wall 46, and the raised portion 422 defines a plurality of through holes 424. The raised portion 422 is used for receiving comparatively taller electronic components 12 on the interface card 10, and supplying a space to provide effective heat dissipation for the electronic components 12 on the interface card 10. Each sidewall 44 comprises a front-side wall 442 and a back-side wall 444. In the exemplary embodiment, a distance between the two front-side walls 442 is equal to or slightly smaller than a width of the front portion 22 of the PCI connector 20, and a distance between the two back-side portions 444 is equal to or slightly smaller than a width of the back portion 24 of the PCI connector 20. In this way, when the holding device 40 is assembled onto the PCI connector 20, the sidewalls 44 of the holding device 40 clamp the two sides of the PCI connector 20.

Figure 3:
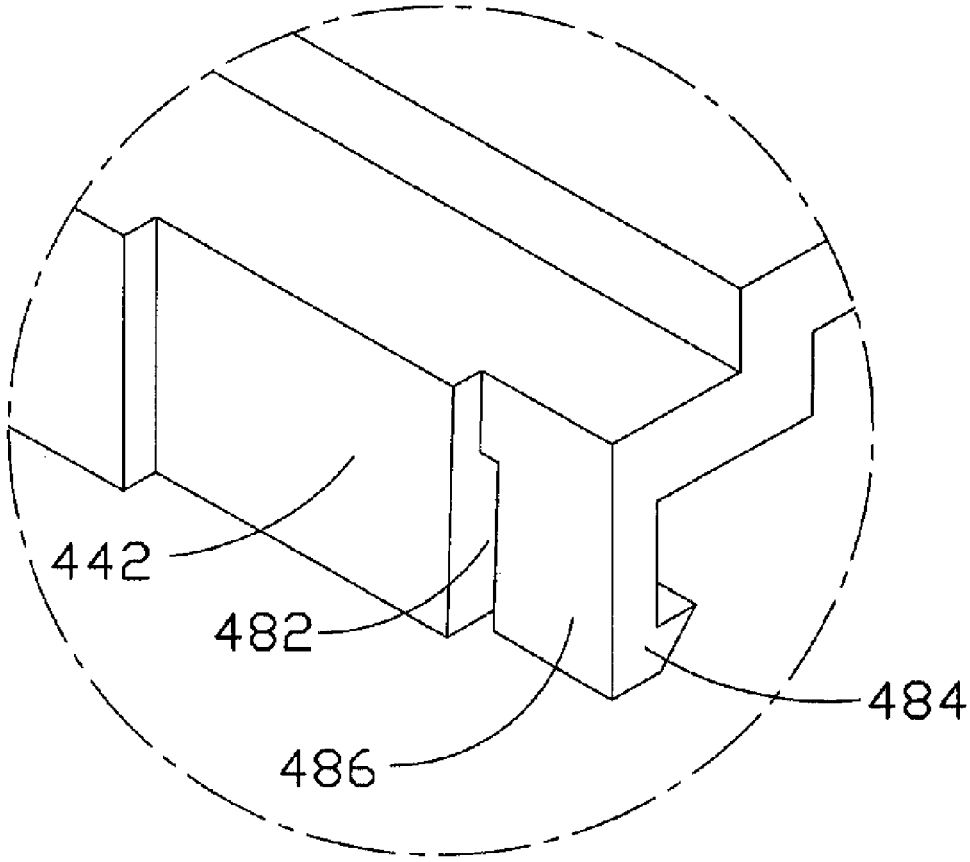
FIG. 3 is an enlarged view of circled portion III of the FIG. 2.

Referring also to FIG. 3, Each holding portion 48 comprises a resilient holding wall 486, and a latching portion 484 protruding in from a distal end of the holding wall 486. The holding walls 486 connect with the top wall 42 and the front-side wall 442. Two slots 482 are respectively defined between the holding walls 486 and front-side walls 442. A distance between the two holding walls 486 is equal to or slightly smaller than a width of the interface card 10. In this way, the two holding walls 486 clamp the two sides of the interface card 10 in assembly. In an alternative exemplary embodiment of the present invention, each holding portion 48 comprises a plurality of holding walls 486, and each holding wall 486 comprises a plurality of latching portions 484.

Figure 4:
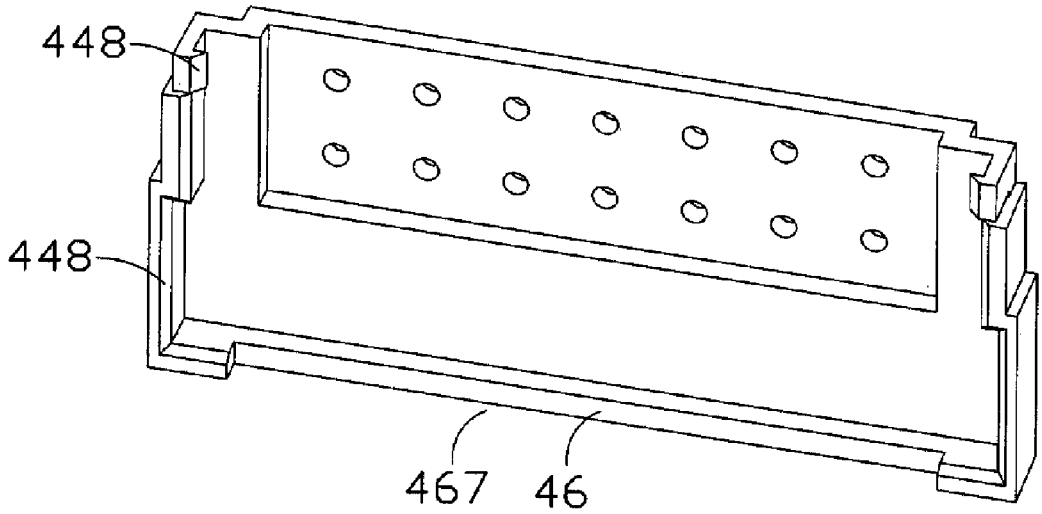
FIG. 4 is similar to FIG. 2, but viewed from another aspect.

Referring also to FIG. 4, the back wall 46 comprises a recessed portion 467 which makes the back wall 46 more flexible. The sidewalls 44, the latching portion 484, and the back wall 46 each comprises a bevel edge 448 at a lower portion thereof to make the holding device 40 convenient for assembly.

In assembly, the interface card 10 is inserted into the PCI connector 20, then, the holding device 40 is pressed onto the PCI connector 20, causing the holding walls 486 to flex outward with the holding portions 48 being pushed by the interface card 10 until the interface card 10 is received between the holding portions 48 and the holding walls 486 rebound. In this assembled state, the sidewalls 44 of the holding device 40 clamp the two sides of the PCI connector 20; the holding walls 486 of the holding device 40 clamp the two sides of the interface card; and the latching portions 484 of the holding device 40 supports a bottom of the interface card 10.

Because the two sides of the PCI connector 20 are clamped by the sidewalls 44 of the holding device 40, the pressure on the two sides of the interface card 10 imposed by the PCI connector 20 is strengthened. Thereby, the interface card 10 is stably clamped by the two sides of the PCI connector 20.

Because the two sidewalls 44 of the holding device 40 clamp the two sides of the PCI connector 20, and the latching portion 484 of the holding device 40 is latched under the bottom of the interface card 10 received in the PCI connector 20, the holding device 40 is stably fixed on the PCI connector 20. Thereby, the holding device 40, the PCI connector 20, and the interface card 10 cooperatively form a steady and interdependent connection, thus preventing accidental separation.

Because the holding device 40 is mounted on the PCI connector 20 without any external latching device or machining device, the holding device 40 does not take up any space of the circuit board, which the PCI connector 20 is positioned on. And because the holding device 40 can be assembled manually without any external tools, the cost of manufacture is lowered.

While exemplary embodiments have been described above, it should be understood that they have been presented by way of example only and not by way of limitation. Thus the breadth and scope of the present invention should not be limited by the above-described exemplary embodiment, but should be defined only in accordance with the following claims and their equivalents.

What is claimed is:

1. A holding device, for fastening an interface card in a peripheral component interconnect (PCI) connector, comprising:

a top wall;

at least a pair of opposite sidewalls, for clamping two sides of the PCI connector, the sidewalls connecting with the top wall; and a pair of holding portions, connecting with the top wall, for fastening and supporting the interface card, each of the holding portions comprising a holding wall for clamping the interface card, and a latching portion for supporting the interface card;

wherein the holding walls respectively connect with the two sidewalls, and two slots are respectively defined between the holding walls and the sidewalls.

2. The holding device as claimed in claim 1, wherein each of the latching portions comprises a bevel edge formed at a lower portion thereof.

3. The holding device as claimed in claim 1, wherein the top wall comprises a raised portion.

4. The holding device as claimed in claim 3, wherein the raised portion defines a plurality of through holes therein.

5. The holding device as claimed in claim 1, wherein the holding device further comprises a back wall connecting with the sidewalls and the top wall, and the back wall comprises a beveled edge formed at a lower portion thereof.

6. The holding device as claimed in claim 5, wherein the back wall further comprises a recessed portion.

7. An electronic product, comprises:

a peripheral component interconnect (PCI) connector;

an interface card received in the PCI connector; and a holding device, for fastening the interface card in the PCI connector, comprising a top wall, at least a pair of sidewalls, and a pair of opposite holding portions, the sidewalls connecting with the top wall and clamping the two sides of the PCI connector, the holding portion connecting with the top wall, and clamping the two sides of the interface card, the holding portions each comprising a holding wall for clamping the interface card, and a latching portion for supporting the interface card;

wherein the holding walls respectively connect with the two sidewalls, and two slots are respectively defined between the holding walls and the sidewalls.

8. The holding device as claimed in claim 7, wherein each of the latching portions comprises a beveled edge formed at a lower portion thereof.

9. The holding device as claimed in claim 7, wherein the top wall comprises a raised portion.

10. The holding device as claimed in claim 9, wherein the raised portion defines a plurality of through holes therein.

11. The holding device as claimed in claim 7, wherein the holding device further comprises a back wall connecting with the sidewalls and the top wall, and the back wall comprises a beveled edge formed at a lower portion thereof.

12. The holding device as claimed in claim 11, wherein the back wall further comprises a recessed portion.

* * * * *